US010675677B2

(12) United States Patent
Brexeler

(10) Patent No.: US 10,675,677 B2
(45) Date of Patent: Jun. 9, 2020

(54) DELIVERY DEVICE FOR A METAL BATH IN A DIECASTING UNIT

(71) Applicant: GEBR. KRALLMANN GMBH, Hiddenhausen (DE)

(72) Inventor: Ingo Brexeler, Wetter/Ruhr (DE)

(73) Assignee: GEBR. KRALLMANN GMBH, Hiddenhausen (DE)

( * ) Notice: Subject to any disclaimer, the term of this patent is extended or adjusted under 35 U.S.C. 154(b) by 179 days.

(21) Appl. No.: 15/535,888

(22) PCT Filed: Dec. 15, 2015

(86) PCT No.: PCT/EP2015/002517

§ 371 (c)(1),
(2) Date: Jun. 14, 2017

(87) PCT Pub. No.: WO2016/096120

PCT Pub. Date: Jun. 23, 2016

(65) Prior Publication Data

US 2017/0348766 A1 Dec. 7, 2017

(30) Foreign Application Priority Data

Dec. 19, 2014 (DE) ..... 10 2014 018 798

(51) Int. Cl.
*B22D 17/04* (2006.01)
*B22D 17/20* (2006.01)
(Continued)

(52) U.S. Cl.
CPC ..... *B22D 17/04* (2013.01); *B22D 17/203* (2013.01); *B22D 17/2023* (2013.01);
(Continued)

(58) Field of Classification Search
CPC .. B22D 17/04; B22D 17/2023; B22D 17/203; B22D 17/2038; B22D 17/30; B22D 17/32
(Continued)

(56) References Cited

U.S. PATENT DOCUMENTS 3,201,836 A 8/1965 Nyselius
3,461,946 A 8/1969 Nyselius
(Continued)

FOREIGN PATENT DOCUMENTS

DE 101 57 349 A1 6/2003
DE 60 2004 004 147 T2 10/2007
(Continued)

*Primary Examiner* — Scott R Kastler
*Assistant Examiner* — Michael Aboagye
(74) *Attorney, Agent, or Firm* — McGlew and Tuttle, P.C.

(57) ABSTRACT

A feed device for a metal melt in an injection molding device of, for example, a metal-molding machine has a reservoir for the metal melt and a feed duct, in which the metal melt can be fed to a mold cavity. The feed duct includes a cylinder bore, in which a piston is arranged axially displaceably. A collection chamber for the metal melt, from which the metal melt can be introduced into the mold cavity through a continuing line as a consequence of an axial displacement of the piston, is provided in the cylinder bore. The cylinder bore is surrounded by a first heater, which has at least one heating element.

20 Claims, 2 Drawing Sheets

(51) Int. Cl.
*B22D 17/30* (2006.01)
*B22D 17/32* (2006.01)

(52) U.S. Cl.
CPC ..... *B22D 17/2038* (2013.01); *B22D 17/30* (2013.01); *B22D 17/32* (2013.01)

(58) Field of Classification Search
USPC ..... 222/596, 597; 164/113, 312, 900; 425/144, 549
See application file for complete search history.

(56) References Cited

U.S. PATENT DOCUMENTS

| | | | | |
|---|---|---|---|---|
| 4,747,770 | A * | 5/1988 | Schmidt | B29C 45/281 264/328.15 |
| 7,034,263 | B2 | 4/2006 | Kagan | |
| 7,034,264 | B2 | 4/2006 | Kagan | |
| 7,279,665 | B2 | 10/2007 | Kagan | |
| 7,652,231 | B2 | 1/2010 | Kagan | |
| 9,138,928 | B2 | 9/2015 | Jörg | |
| 9,561,540 | B2 | 2/2017 | Kusic | |
| 9,676,024 | B2 * | 6/2017 | Wunderle | B22D 17/203 |
| 2003/0094257 | A1 * | 5/2003 | Kono | B22D 17/007 164/113 |
| 2003/0094258 | A1 | 5/2003 | Hartmann et al. | |
| 2005/0000959 | A1 | 1/2005 | Kagan | |
| 2005/0006380 | A1 | 1/2005 | Kagan | |
| 2006/0076338 | A1 | 4/2006 | Kagan | |
| 2006/0219709 | A1 | 10/2006 | Kagan | |
| 2008/0238386 | A1 | 10/2008 | Kagan | |
| 2009/0208600 | A1 | 8/2009 | Akamatsu | |
| 2010/0134082 | A1 | 6/2010 | Kagan | |
| 2013/0302466 | A1 | 11/2013 | Jörg | |
| 2014/0319188 | A1 | 10/2014 | Kusic | |
| 2015/0151357 | A1 | 6/2015 | Wunderle et al. | |

FOREIGN PATENT DOCUMENTS

| | | | | |
|---|---|---|---|---|
| DE | 11 2007 000 642 | T5 | 5/2009 | |
| DE | 10 2008 025 557 | B4 | 4/2010 | |
| DE | 10 2012 102 549 | A1 | 5/2013 | |
| DE | 10 2012 009 412 | A1 | 11/2013 | |
| DE | 10 2012 010 923 | A1 | 12/2013 | |
| DE | 102012010923 | * | 12/2013 | B22D 17/04 |
| EP | 1 302 261 | A2 | 4/2003 | |
| JP | S63-109031 | A | 5/1988 | |
| JP | H08-257723 | A | 10/1996 | |
| JP | 11-188769 | * | 7/1999 | B22D 17/04 |
| JP | 2001-030060 | | 2/2001 | |
| JP | 2007-061880 | A | 3/2007 | |
| JP | 2015-519204 | A | 7/2015 | |

* cited by examiner

DELIVERY DEVICE FOR A METAL BATH IN A DIECASTING UNIT

CROSS REFERENCE TO RELATED APPLICATIONS

This application is a United States National Phase Application of International Application PCT/EP2015/002517, filed Dec. 15, 2015, and claims the benefit of priority under 35 U.S.C. § 119 of German Application 10 2014 018 798.5, filed Dec. 19, 2014, the entire contents of which are incorporated herein by reference.

FIELD OF THE INVENTION

The present invention pertains to a feed device for a metal melt in an injection molding device, with a reservoir for the metal melt and with a feed duct, in which the metal melt can be fed to a mold cavity, wherein the feed duct comprises a cylinder bore, in which a piston is arranged axially adjustably, and wherein a collection chamber is provided for the metal melt in the cylinder bore, and the metal melt can be introduced from the collection chamber into the mold cavity through a continuing line as a consequence of an axial displacement of the piston.

BACKGROUND OF THE INVENTION

A molten metal, which is usually a metal alloy, is introduced in a metal-casting machine into a mold cavity, and it hardens in this, so that a metallic component corresponding to the mold cavity is formed. The metal melt is introduced here under a pressure under which the metal melt is placed.

DE 10 2012 010 923 A1 discloses a feed device for a metal melt, in which the metal melt is fed from a reservoir to a collection chamber formed in a cylinder bore, after which a piston is axially displaced in the cylinder bore, as a result of which the metal melt is pushed out of the collection chamber and reaches a continuing line, in which it is fed to the mold cavity.

The quality of the metal component manufactured with a corresponding injection molding unit depends substantially on the fact that the metal melt has a sufficient flowability on its feed path between the reservoir and the mold cavity and does not become viscous on the feed path or it does not even solidify. To achieve this, it is known that the metal melt is heated to a sufficient temperature in the reservoir in order to ensure that the metal melt still has a sufficiently high temperature and hence good flowability on its entry into the mold cavity. However, it proved to be relatively difficult in practice to ensure a sufficient temperature control and hence flowability for the large number of possible metal alloys that can be processed with the injection molding unit.

SUMMARY OF THE INVENTION

A basic object of the present invention is to provide a feed device for a metal melt in an injection molding device, in which feed device good flowability can be achieved over the feed path for different metallic materials as well.

This object is accomplished according to the present invention by a feed device for a metal melt in an injection molding device, which has the features according to the invention. Provisions are made here for the cylinder bore, in which the collection chamber is formed, to be surrounded by a heater (first heater), which has at least one heating element.

The present invention is based on the basic idea of setting or holding the metal melt to/at a desired temperature over its feed path between the reservoir and the mold cavity in at least some sections by using a first heater in order to prevent the metal melt to lose some of its flowability over its feed path. On the other hand, the use of the first heater in the area of the cylinder bore is associated with the further advantage that the metal melt does not have to be excessively heated in the reservoir, so that the risk that additional attached parts, especially electronic controls or driving devices of the feed device, will be damaged or their function will be impaired, is prevented.

The first heater preferably comprises a plurality of heating elements, which are arranged over the circumference of the cylinder bore, especially in a uniformly distributed manner, and which may extend, for example, at a radially spaced location from the cylinder bore and parallel to same. The heating elements may be formed by electrical heating cartridges, which are inserted each into a hole in the housing of the feed device. The heating cartridges represent an electrical resistance heater, but it is also possible, as an alternative, that the first heater is formed by ducts, through which a hot fluid and especially a hot liquid flows.

The number and arrangement of the heating elements depends on the size of the injection molding device and especially of the cylinder bore, but it proved to be meaningful in practice if four to eight heating elements are used, but the present invention is not limited to this.

An accurate temperature control of the wall of the cylinder bore as well as of the surrounding components and hence also of the metal melt can be achieved if the heating elements can be actuated individually and/or in groups. In a variant of the present invention, a regulation can be used, in which the temperature of the individual heating elements and/or of the metal melt and/or of the wall of the cylinder bore is detected and analyzed, and the heating elements are actuated individually or in groups in order to attain the desired temperature or a desired temperature profile.

The piston can be adjusted axially within the cylinder bore in order to push out the metal melt located in the collection chamber from same. A preferably electrical or hydraulic driving device and/or an electronic control device, which are usually arranged at the upper end of the piston, may be provided for this purpose. The driving device and/or the control device are temperature-sensitive components, which are prone to malfunction in case of excessive heating. To guarantee proper operation of the driving device and/or of the control device despite the heating of the metal melt by the first heater, provisions may be made in a variant of the present invention for a cooling device to be associated with the driving device and/or the control device. The cooling device may be either an electrical cooling device, for example, a Peltier element, or cooling ducts, through which a cooling fluid, especially a cooling liquid, flows.

Provisions are made in a preferred embodiment of the present invention for a partition, through which the piston passes, to be provided between the heater and the cooling device. The partition is used as a heat shield and it shields the area heated by means of the heater and the area cooled by means of the cooling device from one another.

Provisions are made in a preferred embodiment of the present invention for the partition to be able to be cooled by means of the cooling device by, for example, a cooling duct being integrated in the partition.

It is known that the piston has an axial bore, in which a valve rod is displaceably mounted. Provisions may be made for the valve rod to have, at its end facing away from the collection chamber, a valve rod driving device, especially in the form of an electrical drive motor or a hydraulic driving device and/or an electronic control device, wherein the valve rod driving device and/or the control device can be cooled by means of the cooling device. Proper function of the valve rod driving device and/or of the control device and hence of the valve rod is also guaranteed in this manner.

To guarantee sufficient flowability of the metal melt over its feed path, it is useful that the temperature of the metal melt be accurately controlled in the reservoir. Provisions may be made for this purpose for another heater (second heater), which can be actuated independently from the first heater for the cylinder bore, to be associated with the reservoir of the metal melt.

Moreover, it is meaningful for the flowability of the metal melt if an excessive slag layer is prevented from forming on the surface of the metal melt in the reservoir, because this implies the risk that slag particles will enter the feed path through the feed device. To prevent this, provisions may be made in a variant of the present invention for the metal melt to be maintained under a protective gas atmosphere in the reservoir. For example, the interior space of the reservoir above the metal melt may be filled with carbon dioxide ($CO_2$) or nitrogen ($N_2$) and the metal melt may be exposed these gases.

The metal melt is pushed out of the collection chamber by the piston and it enters a continuing line, in which a nonreturn valve is usually arranged. Provisions are made in a variant of the present invention for a further heater (third heater), which can be actuated independently from the first heater for the cylinder bore and independently from the second heater for the reservoir, to be associated with the nonreturn valve.

Both the second heater and the third heater may be formed by electrical resistance heaters, for example, heating cartridges, but it is also possible to provide heating ducts, through which a hot fluid and especially a hot liquid flows.

Further details and features of the present invention are described in the following description of an exemplary embodiment with reference to the drawings.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
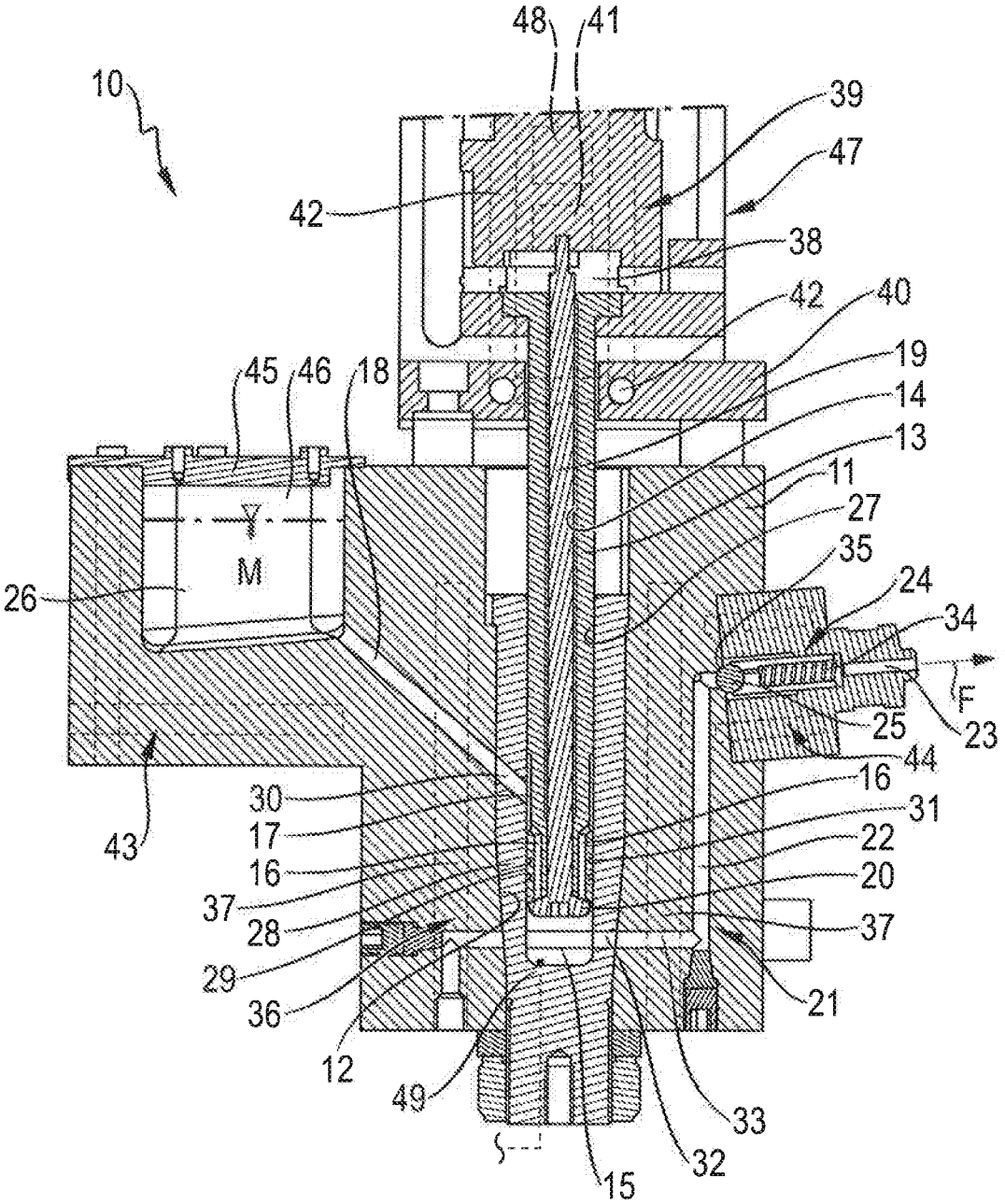
FIG. 1 is a longitudinal sectional view through a feed device according to the present invention.

Referring to the drawings, a feed device 10 for a metal melt M in an injection molding device, which feed device is shown in FIG. 1, has a housing 11, in which a vertical receiving hole 12 is formed.

A reservoir 26, which is filled with the metal melt M, is provided in the housing 11. The metal melt M may be fed to the reservoir 26 in the molten form or produced in this by melting, for example, metal granules.

The reservoir 26 is covered airtightly by means of a cover part 45 and the free space 46 formed above the metal melt M in the reservoir 26 is filled with a protective gas, for example, carbon dioxide ($CO_2$) or nitrogen ($N_2$).

A second heater 43, which may be an electrical resistance heater and with which the wall of the reservoir 26 and hence the metal melt M can be brought to a desired temperature or maintained at such a temperature, is integrated in the housing 11 in the area of the reservoir 26.

Via at least one feed channel 18 extending with a downward slope in the flow direction, the reservoir 26 is in connection with the receiving hole 12. An adapter 28, which has a tubular configuration and is closed at its lower end, is inserted with close fit into the receiving hole 12. The adapter 28 is held replaceably in the receiving hole 12 and has a central axial cylinder bore 27, which is configured in the form of an upwardly open blind hole. An obliquely extending connection hole 30, which is flush with the feed channel 18 and connects same with the cylinder bore 27, is provided in the wall of the adapter 28.

A piston 13 is displaceably inserted into the cylinder bore 27 with close fit. An annular space 17 is formed on the outside of the piston 13 in an area, which is arranged in the lower half of the axial length of the piston 13 and which is located at an axially spaced location from the lower end of the piston 13. A plurality of filling holes 16, arranged distributed over the circumference of the piston 13, extend in the piston 13 towards the lower end face of the piston 13 at the lower end of the annular space 17. The area of the piston 13 in which the filling holes 16 are formed is in contact in a sealed manner with the inner wall of the cylinder bore 27.

Two circumferential grooves 29, which are located at axially spaced locations and into which a slotted piston ring 31 each is inserted, are formed on the outer jacket surface of the piston 13, said piston ring 31 being sealingly in contact with the inner wall of the cylinder bore 27 under a spring tension directed radially outwardly against the inner wall of the cylinder bore 27. The piston rings 31 consist, for example, of a spring steel.

The piston 13 further has a central axial hole 14, in which a valve rod 19, which passes completely through the piston 13 and carries a plate-shaped valve body 20 at its lower end downstream of the end face of the piston 13, is arranged displaceably. By displacing the valve rod 19 relative to the piston 13, the valve body 20 can be adjusted between a closed position shown in FIG. 1, in which the valve body 20 prevents metal melt from flowing out of the filling holes 16, and an open position, not shown, in which the metal melt can flow from the filling holes into a collection chamber 15, which is located under it and is formed in the cylinder bore 27.

The cross section of the valve body 20 is smaller than the cross section of the cylinder bore 27, so that the valve body 20 has a sealing function within the cylinder bore 27 and the metal melt M can flow freely around the valve body 20.

A pressure sensor 49, which is only suggested and sends a pressure signal via a line to a control device, not shown, which controls the drive of the piston 13, is arranged in the collection chamber 15. A control circuit is thus obtained for the drive (hydraulic cylinder) of the piston 13.

The cylinder bore 27 or the collection chamber 15 formed in its lower area is connected to a mold cavity, not shown specifically, via a continuing line 21. The continuing line 21 comprises a lower cross hole 32 in the wall of the adapter 28, which cross hole is flush with a continuing cross hole 33 in the housing 11, via which the collection chamber 15 is connected to a vertical riser 22 via said cross hole 33. The riser 22 passes over at its upper end into a filling duct 23, from which the metal melt is fed to the mold cavity, as is indicated by the arrow F. A nonreturn valve 24, which has a valve body 25, which is tensioned by a spring 34 against the flow direction against a valve seat 35, is arranged in the transition between the riser 22 and the filling duct 23.

Figure 2:
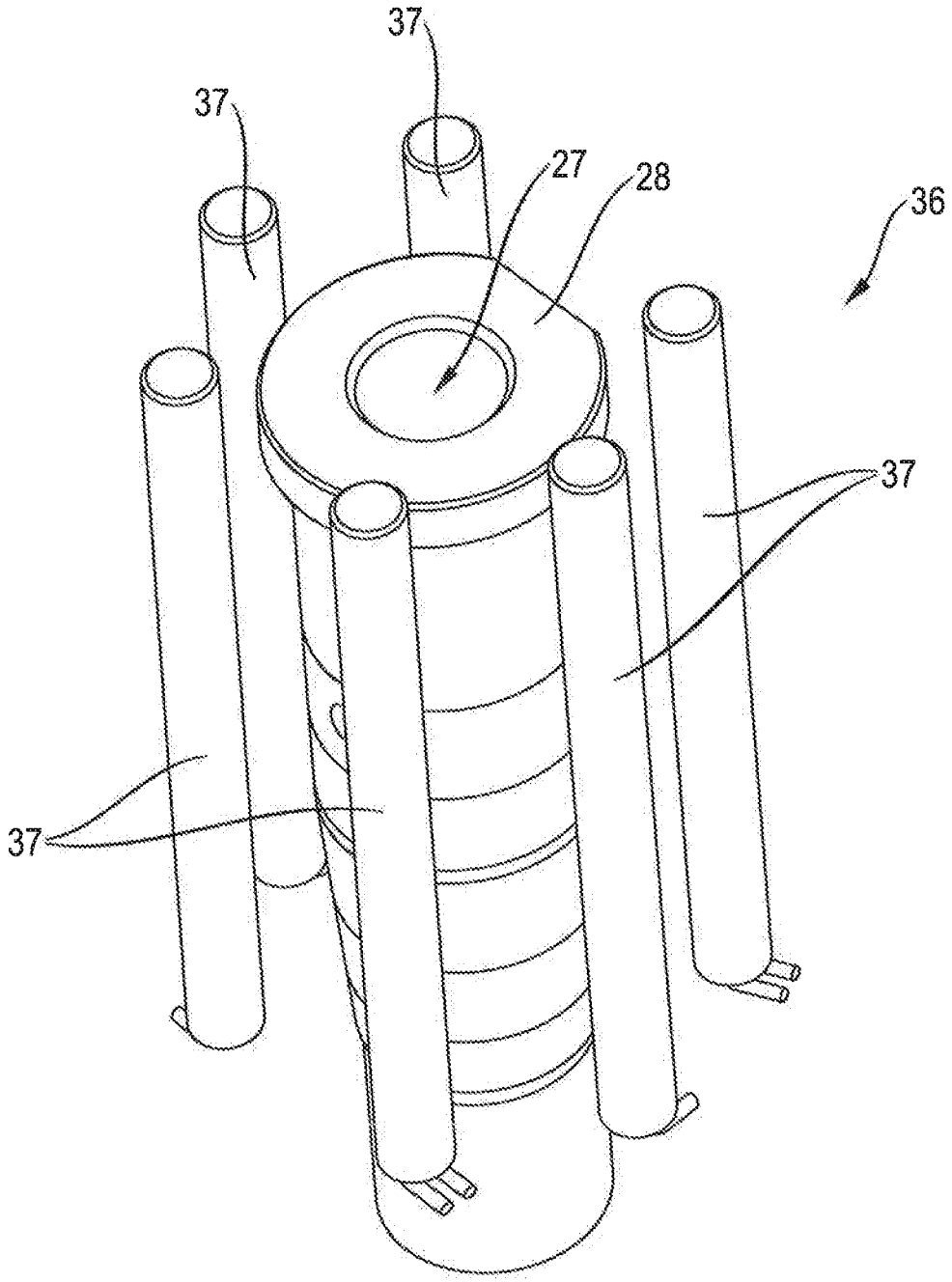
FIG. 2 is an enlarged perspective view of the cylinder bore with a heater arranged on the outside.

The cylinder bore 27 and the adapter 28 are surrounded by a first heater 36, which has a plurality of heating elements 37, which are arranged distributed over the circumference of the adapter 28 and are each inserted into a hole formed in the housing, as is indicated by broken line in FIG. 1. The arrangement of the heating elements 37, which are preferably electrical heating cartridges, is shown in FIG. 2. It is seen from this that six heating elements 37 are provided, which are distributed uniformly over the circumference of the adapter 28 and can preferably be actuated each individually or in groups. It is possible by means of the heater 36 to bring the metal melt M to a desired temperature or to maintain it at that temperature in the area of the connection hole 30, the filling holes 16, the collection chamber 15 and, at least in some sections, in the continuing line 21.

As is suggested in FIG. 1, a third heater 44, with which the temperature of the metal melt, which flows through the nonreturn valve 24, is controlled, especially within the nonreturn valve 24, is associated with the nonreturn valve 24. The third heater 44 may be formed by an electrical resistance heater or heating ducts, through which a hot fluid and especially a hot liquid flows.

The end of the piston 13 and of the valve rod 19 facing the collection chamber 15 is arranged in a drive and control housing 47, which is arranged on the outside of the housing 11 and in which a driving device 38, only suggested, for the piston 13 and a valve rod driving device 41, which are likewise only suggested and with which the piston 13 or the valve rod 19 are axially adjustable, are arranged. An electronic control device 48 is provided, likewise within the driving and control housing 47, especially for said driving devices, which is indicated only schematically. The drive and control housing 47 has, on its side facing the housing 11, a partition 40, through which the piston 13 and the valve rod 19 pass with a close fit and which is used as a heat shield.

A cooling device 39, which comprises a plurality of cooling ducts 42, through which a cooling liquid flows and extend through both the drive and control housing 47 and the partition 40, is further provided in the driving and control housing 47. It is possible by means of the cooling device 39 to maintain the interior space of the drive and control housing 47 and hence the driving device 38 for the piston 13, the valve rod driving device 41 and the electronic control device 48 at an advantageous operating temperature of preferably <80° C., because there is a risk due to the heater 36 that the components mentioned would otherwise become too hot and would be damaged as a result.

While specific embodiments of the invention have been shown and described in detail to illustrate the application of the principles of the invention, it will be understood that the invention may be embodied otherwise without departing from such principles.

The invention claimed is:

1. A feed device for a metal melt in an injection molding device, the feed device comprising:

a reservoir for the metal melt;

a continuing line;

a feed path comprising:

a feeding duct, in which the metal melt is fed to a mold cavity;

a cylinder bore;

a piston arranged axially displaceably in the cylinder bore; and a collection chamber for the metal melt, from which the metal melt is introduced into the mold cavity through the continuing line as a consequence of an axial displacement of the piston, the collection chamber being provided in the cylinder bore;

a heater, wherein the cylinder bore is surrounded by the heater, which heater has at least one heating element;

a piston driving device and/or a control device at an end of the piston facing away from the collection chamber;

a cooling device associated with the driving device and/or the control device such that the piston driving device and/or the control device is cooled by the cooling device; and a partition through which the piston passes, wherein the partition is provided between the heater and the cooling device.

2. A feed device in accordance with claim 1, wherein the partition is cooled by the cooling device.

3. A feed device in accordance with claim 1, wherein the heater comprises at least another heating element to provide a plurality of heating elements arranged distributed over a circumference of the cylinder bore.

4. A feed device in accordance with claim 3, wherein the heating elements are heating cartridges extending at radially spaced locations from and parallel to the cylinder bore.

5. A feed device in accordance with claim 3, wherein the plurality of heating elements comprises four to eight heating elements.

6. A feed device in accordance with claim 3, wherein the heating elements are configured to be actuated individually and/or in groups.

7. A feed device in accordance with claim 1, further comprising a valve rod and a valve rod driving device, wherein the piston has an axial hole, in which the valve rod is received displaceably, the valve rod is operably connected to the valve rod driving device at an end of the valve rod facing away from the collection chamber and the valve rod driving device and/or the control device are cooled by the cooling device.

8. A feed device in accordance with claim 1, wherein the cooling device comprises at least one cooling duct, through which a cooling fluid flows.

9. A feed device in accordance with claim 1, wherein the metal melt is maintained in the reservoir under a protective gas atmosphere.

10. A feed device in accordance with claim 1, further comprising another heater associated with the reservoir of the metal melt.

11. A feed device in accordance with claim 10, wherein a nonreturn valve is arranged in the continuing line and a further heater is associated with the nonreturn valve.

12. A feed device in accordance with claim 1, wherein a nonreturn valve is arranged in the continuing line and a further heater is associated with the nonreturn valve.

13. A feed device in accordance with claim 8, wherein the cooling fluid is a cooling liquid.

14. A feed device in accordance with claim 1, wherein the partition is arranged between the reservoir and the piston driving device and/or the control device.

15. A feed device for a metal melt in an injection molding device, the feed device comprising:

a feed device housing comprising a reservoir for the metal melt, a continuing line, a cylinder bore and a collection chamber;

a drive control housing located at spaced location from the feed device housing;

a piston, at least a portion of the piston being arranged in the cylinder bore and at least another portion of the piston being arranged in the drive control housing, the continuing line, the cylinder bore and the collection chamber defining at least a portion of a metal melt feed path, wherein the metal melt is fed to a mold cavity via the metal melt feed path, the metal melt being introduced from the collection chamber into the mold cavity through the continuing line via axial displacement of the piston, the collection chamber being provided in the cylinder bore;

a heater, wherein the cylinder bore is surrounded by the heater, the heater having at least one heating element;

a piston driving device and/or a control device at an end of the piston facing away from the collection chamber, the piston driving device and/or the control device being arranged in the drive control housing;

a cooling device associated with the driving device and/or the control device such that the piston driving device and/or the control device is cooled by the cooling device, the cooling device being arranged in the drive control housing; and a partition through which the piston passes, wherein the partition is provided between the feed device housing and the drive control housing.

16. A feed device in accordance with claim 15, wherein the partition is provided between the heater and the cooling device.

17. A feed device in accordance with claim 16, wherein the partition is cooled via the cooling device.

18. A feed device in accordance with claim 17, wherein the feed device housing comprises a feed duct, the feed duct being in fluid communication with the reservoir and the cylinder bore, the metal melt feed path comprising the feed duct.

19. A device in accordance with claim 16, wherein the partition is located between the reservoir and the drive control housing.

20. A feed device in accordance with claim 16, wherein the partition is arranged between the reservoir and the piston driving device and/or the control device.

* * * * *